US007690053B2

(12) United States Patent
Pondelick

(10) Patent No.: US 7,690,053 B2
(45) Date of Patent: Apr. 6, 2010

(54) VACUUM TOILET ASSEMBLY

(75) Inventor: Mark Pondelick, Rockton, IL (US)

(73) Assignee: MAG Aerospace Industries, Inc., Carson, CA (US)

( * ) Notice: Subject to any disclaimer, the term of this patent is extended or adjusted under 35 U.S.C. 154(b) by 139 days.

(21) Appl. No.: 11/159,870

(22) Filed: Jun. 23, 2005

(65) Prior Publication Data

US 2006/0288472 A1 Dec. 28, 2006

(51) Int. Cl.
*E03D 11/00* (2006.01)

(52) U.S. Cl. ..... 4/435; 4/431

(58) Field of Classification Search ..... 4/334, 4/420, 431, 432, 434–436
See application file for complete search history.

(56) References Cited

U.S. PATENT DOCUMENTS

| | | | | |
|---|---|---|---|---|
| 3,590,397 | A | | 7/1971 | Akamatsu et al. |
| 3,996,628 | A | | 12/1976 | Mollerstedt |
| 4,232,409 | A | | 11/1980 | Van Pham |
| 4,275,470 | A | | 6/1981 | Badger et al. |
| 4,276,663 | A | | 7/1981 | Gensurowsky |
| 4,306,321 | A | * | 12/1981 | Norlin ..... 4/321 |
| 4,376,314 | A | | 3/1983 | Iwans |
| 4,439,874 | A | | 4/1984 | Schrock |
| 4,510,629 | A | | 4/1985 | Jovy et al. |
| RE32,750 | E | | 9/1988 | Grills et al. |
| 4,882,792 | A | | 11/1989 | Vincent |
| 4,905,325 | A | | 3/1990 | Colditz |
| 4,928,326 | A | | 5/1990 | Olin et al. |
| 5,007,117 | A | | 4/1991 | Oldfelt et al. |
| 5,035,011 | A | | 7/1991 | Rozenblatt et al. |
| 5,035,140 | A | | 7/1991 | Daniels et al. |
| 5,067,181 | A | | 11/1991 | Hafner et al. |
| 5,123,124 | A | | 6/1992 | Brower |
| 5,232,010 | A | | 8/1993 | Rozenblatt et al. |
| 5,282,281 | A | | 2/1994 | Clear et al. |
| 5,421,040 | A | * | 6/1995 | Oldfelt ..... 4/435 |
| 5,426,794 | A | | 6/1995 | Hennessy |
| 5,454,936 | A | | 10/1995 | Ask et al. |
| 5,515,555 | A | | 5/1996 | Wormcke |
| 5,524,655 | A | | 6/1996 | Powers et al. |
| 5,692,250 | A | | 12/1997 | Oldfelt et al. |
| 5,832,546 | A | | 11/1998 | Inch |
| 6,006,373 | A | | 12/1999 | Hoang |
| 6,085,366 | A | | 7/2000 | Pondelick et al. |
| 6,143,185 | A | | 11/2000 | Tracy et al. |

(Continued)

FOREIGN PATENT DOCUMENTS

| | | |
|---|---|---|
| EP | 0363012 | 4/1990 |

OTHER PUBLICATIONS

Office Action dated Apr. 03, 2008 in related U.S. Appl. No. 11/473,895.

(Continued)

*Primary Examiner*—Huyen Le
(74) *Attorney, Agent, or Firm*—Dean W. Russell; Kristin M. Crall; Kilpatrick Stockton LLP

(57) ABSTRACT

Vacuum toilet assemblies are detailed. These assemblies are designed to reduce both operational noise and water usage of the toilets while continuing to promote effective disposal of waste. They also require less air for operation than do conventional vacuum toilets.

9 Claims, 2 Drawing Sheets

U.S. PATENT DOCUMENTS

| | | | | |
|---|---|---|---|---|
| 6,223,361 | B1 | 5/2001 | Rozenblatt | |
| 6,226,807 | B1 | 5/2001 | Rozenblatt et al. | |
| 6,330,725 | B1 | 12/2001 | Karlsson et al. | |
| 6,385,789 | B1 | 5/2002 | Pondelick et al. | |
| 6,401,270 | B1 | 6/2002 | Moore | |
| 6,434,759 | B1 | 8/2002 | Pondelick et al. | |
| 6,510,564 | B1 | 1/2003 | Karlsson et al. | |
| 6,640,701 | B2 | 11/2003 | Hoehne et al. | |
| 6,702,942 | B1 | 3/2004 | Nield | |
| 6,977,005 | B2 | 12/2005 | Erdmann et al. | |
| 7,533,426 | B2 | 5/2009 | Pondelick | |
| 2002/0112281 | A1 * | 8/2002 | Erdmann et al. | 4/321 |
| 2002/0133869 | A1 | 9/2002 | Pondelick et al. | |
| 2002/0144337 | A1 | 10/2002 | Go | |
| 2007/0102370 | A1 | 5/2007 | Hoffjann et al. | |
| 2007/0151020 | A1 | 7/2007 | Pondelick | |

OTHER PUBLICATIONS

Response dated Sep. 24, 2008 in related U.S. Appl. No. 11/473,895.
Office Action dated Dec. 19, 2008 in related U.S. Appl. No. 11/473,895.
Response dated Feb. 18, 2009 in related U.S. Appl. No. 11/473,895.
Notice of Allowance dated Mar. 19, 2009 in related U.S. Appl. No. 11/473,895.

* cited by examiner

CROSS SECTION OF DISTRIBUTION RING

VACUUM TOILET ASSEMBLY

FIELD OF THE INVENTION

This invention relates to waste disposal and more particularly, but not necessarily exclusively, to vacuum toilet assemblies preferably used in vehicles such as airplanes.

BACKGROUND OF THE INVENTION

U.S. Pat. No. 6,401,270 to Moore, incorporated herein in its entirety by this reference, discloses a conventional hydraulic toilet in which positive pressure is used to facilitate discharging waste from a toilet pan or bowl. A closeable lid may be sealed to the bowl to define a chamber, with an air displacement unit connected to the chamber utilized to increase air pressure therein. The toilet of the Moore patent is not a vacuum type, however, and the Moore patent neither contemplates nor suggests means for reducing noise associated with operation of the toilet.

Unlike the Moore patent, U.S. Pat. No. to Olin, et al. (also incorporated herein in its entirety by reference) does detail a vacuum-type toilet. According to the Olin patent, operational noise of the toilet may be diminished through use of "a lid forming a substantially airtight and soundproof closure at the top of the bowl." See Olin, Abstract, 11. 15-17. Air may be supplied to the toilet bowl via a tube or pipe entering at the back thereof if closing the lid results in too little air being present in the bowl for efficient flushing of waste. The Olin patent does not, however, address reducing water consumption in such a toilet design.

SUMMARY OF THE INVENTION

The present invention is intended to reduce both operational noise and water usage of a vacuum-type toilet while continuing to promote effective disposal of waste. It also allows for the amount of air per flush to be regulated compared to conventional vacuum toilets. In passenger aircraft, for example, reducing the amount of air required for toilet operation commensurately reduces the amount of cabin air necessarily replaced following use of the toilet. Because air has tendency to dry waste, using less air may also promote overall waste-system hygiene by reducing build-up of solids in waste-disposal piping.

Included as components of a toilet assembly of the present invention are a bowl having a rim and a shroud to which a lid is fitted. When closed, the lid is designed to seal against the upper surface of the shroud. Magnetic switches or other suitable means communicating with the flush mechanism may be used to ensure the lid is closed before the toilet is flushed.

Defined along the interior of the rim of the bowl may be a distribution "ring" at or through which both water and air may enter. Although preferably entering through separate openings in the distribution ring, the water and air combine upon entry into the bowl and are pulled through the bowl by evacuation thereof. Airflow pattern down the bowl face generates an "air knife" effect, which accelerates the water, in turn more efficiently removing waste from the bowl. This effect additionally reduces the overall amount of water needed to rinse the bowl effectively. In one presently-preferred embodiment, for example, only two and one half to three ounces of water may be needed for effective flushing.

Further, closing the lid and sealing it against the shroud reduces the amount of air entering the waste system via the bowl. Together with having air enter via the distribution ring under the shroud of the bowl, this sealing greatly reduces the noise associated with flushing the toilet. In a preferred embodiment, noise levels of less than eighty-four decibels have been achieved. For vehicle-mounted toilets, closing and sealing the lid also prevents flushing noise from reflecting off internal panels of the associated lavatory and escaping through door vents so as to disturb other passengers.

It thus is an optional, non-exclusive object of the present invention to provide improved vacuum-toilet assemblies.

It is another optional, non-exclusive object of the present invention to provide vacuum toilets which reduce air flow into the toilet bowl, require less water for effective flushing, and diminish the overall noise volume associated with flushing the toilets.

It is also an optional, non-exclusive object of the present invention to provide toilets in which lids seal with shrouds prior to flushing.

It is a further optional, non-exclusive object of the present invention to provide vacuum toilets having a distribution ring located along the rims of the bowls under the shrouds.

It is, moreover, an optional, non-exclusive object of the present invention to provide vacuum toilets in which both air and water enter the bowls via the distribution rings.

It is yet another optional, non-exclusive object of the present invention to provide vacuum toilets in which evacuation of the bowls produces an air-knife effect.

Other objects, features, and advantages of the present invention will be apparent to those skilled in the relevant field with reference to the remaining text and drawings of this application.

DETAILED DESCRIPTION

Figure 1:
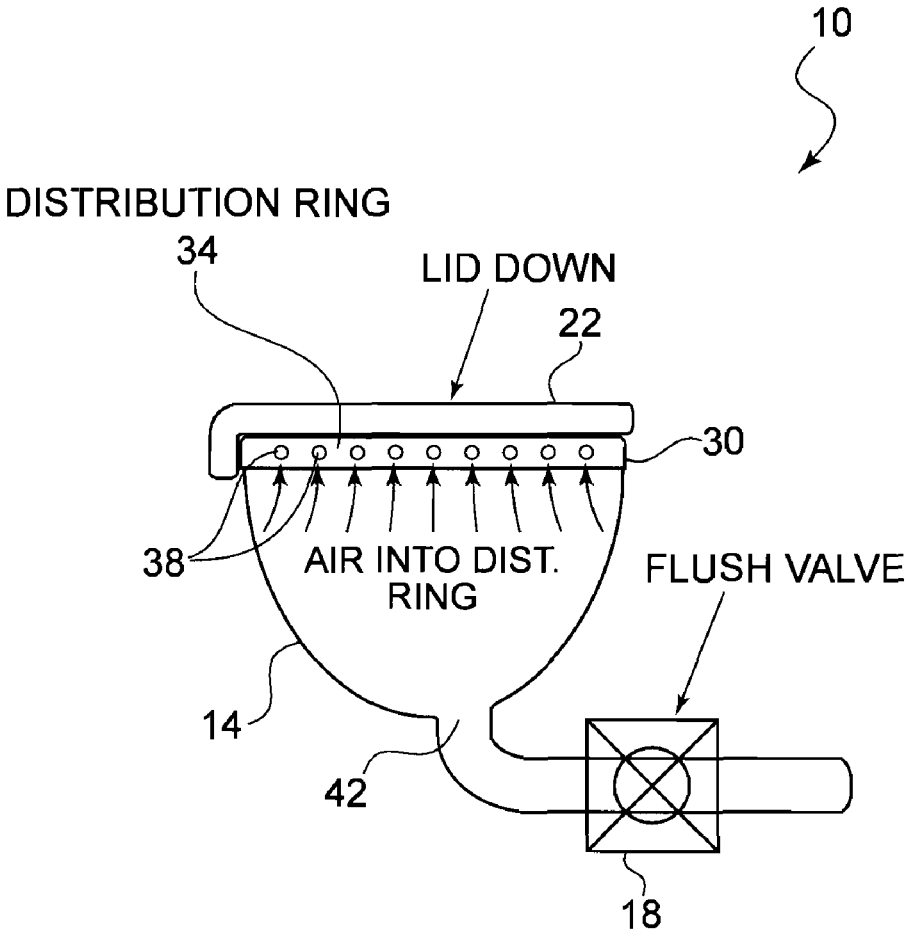
FIG. 1 is a partially-schematicized view of an exemplary vacuum-toilet assembly of the present invention.
Figure 2:
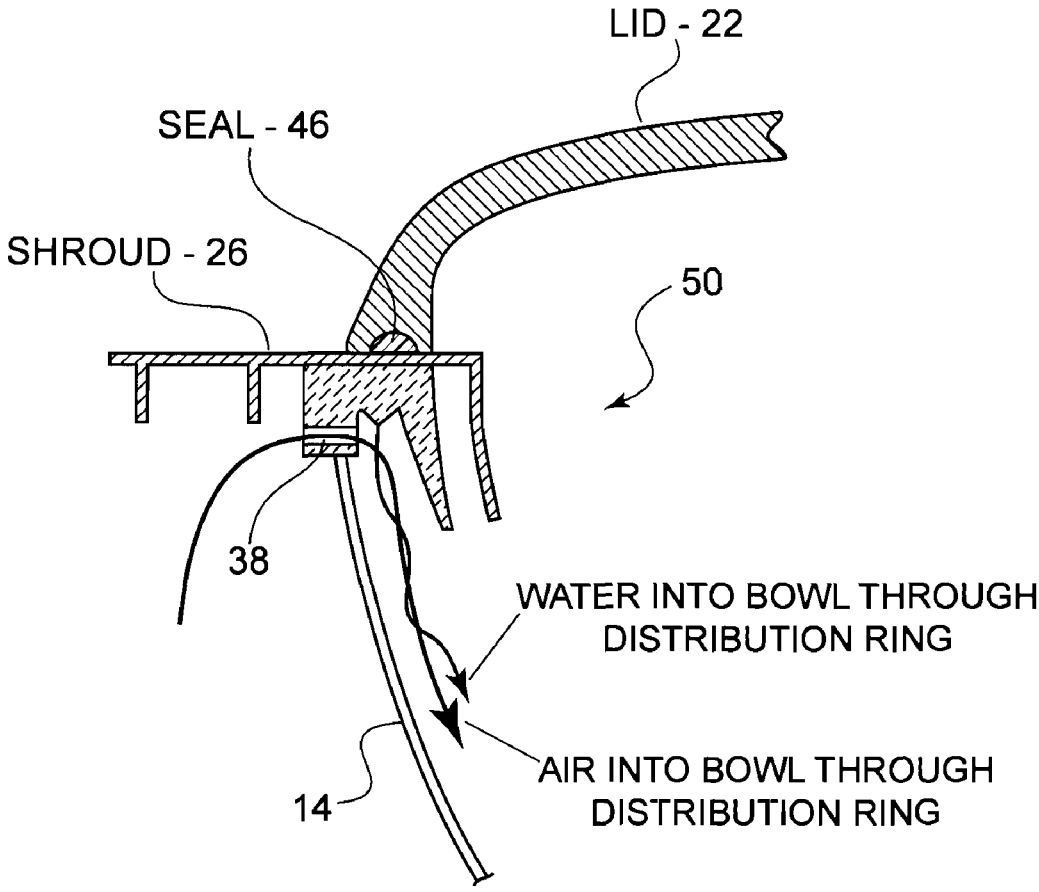
FIG. 2 is a cross-sectional view of a portion of the toilet assembly of FIG. 1.

Illustrated in FIGS. 1-2 are aspects of toilet assembly 10 of the present invention. Included as part of assembly 10 may be toilet bowl 14, flush valve 18, and lid 22. Additionally included may be shroud 26, which in use typically surrounds the periphery of bowl 14 at or adjacent (and slightly above) rim 30. Assembly 10 advantageously is of the vacuum type, in which waste is removed from bowl 14 by evacuating it. Assembly 10 additionally is especially designed for use in passenger aircraft, although it may function suitably in other vehicles, in buildings, or in other locations or objects as well.

Assembly 10 may include some or all of the valves, ducts, and other components described in the Olin patent. Beneficially, however, bowl 14 defines distribution ring 34, preferably located within the bowl 14 at rim 30. Both water and air may enter bowl 14 at ring 34, promoting good mixing of the water and air upon entry into the bowl 14.

Water may be supplied to bowl 14 in conventional ways, including via a pipe designed to discharge the water along ring 34. Air preferably enters bowl 14 through at least one (and beneficially multiple) openings 38 through the wall of bowl 14 at rim 30. Such openings 38 are below the level of shroud 26, thereby limiting the amount of air available to them. Openings 38 are, however, at approximately the level of the water entering bowl 14, allowing immediate mixing of the water and air at a point well above bottom section 42 of the bowl 14.

Either or both of lid 22 and shroud 26 may include sealing material such as gasket 46. Although any suitable sealing material or mechanism may be employed, gasket 46 functions to create an air-impervious seal between lid 22 and shroud 26 and prevent air from above shroud 26 entering bowl 14 through main waste-receiving opening 50 when the lid 22 is closed (as shown in FIGS. 1-2). Although not illustrated in FIGS. 1-2, assembly 10 additionally may, if desired, comprise a magnetic switch or other mechanism designed to communicate with valve 18 and prevent flushing of bowl 14 unless lid 22 is closed. One such approach could employ a magnet placed in lid 22 and a corresponding magnetic switch placed under shroud 26. Another example could include an automatically-closing lid 22 which could be activated via an infrared sensor or otherwise so as to be hands-free.

When assembly 10 is flushed, water and air enter bowl 14 at distribution ring 34, are mixed, and are pulled toward bottom section 42 as bowl 14 evacuates. Air flow patterns across the interior face of bowl 14 generate an "air knife" effect, accelerating the flow of the water. Increased force applied to the water provides a more efficient way of removing waste within bowl 14. This effect also reduces the overall amount of water needed to rinse bowl 14 effectively. Indeed, some embodiments of assembly 10 require only approximately two and one half to three ounces of water to flush satisfactorily, significantly less water than used by vacuum toilets currently employed on aircraft.

Because lid 22 is closed during flushing of assembly 10, the amount of air pulled through bowl 14 during the flush may be regulated (depending on the number and size of openings 38). Further, because lid 22 is closed and air is pulled from areas below shroud 26, the noise associated with the flush is substantially reduced. Although lid 22 is likely subjected to greater pressure than ambient (e.g. than aircraft cabin pressure) when assembly 10 is flushed, such pressure differential is only approximately two to four inches of mercury, within the stress capabilities of existing lids.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. A vacuum toilet assembly comprising:

a. a bowl comprising a wall defining a rim, a bottom section below the rim, and a waste-receiving opening;

b. a moveable lid adapted, when closed, to cover the bowl;

c. system for introducing water into the bowl at or adjacent the rim;

d. multiple air-inlet openings positioned approximately at the same level as the system for introducing water so that air and water entering the bowl immediately mix together at a point well above the bottom section of the bowl.

2. A vacuum toilet assembly according to claim 1 in which the multiple air-inlet openings are distributed around the rim in a ring.

3. A vacuum toilet assembly according to claim 2 further comprising a system for evacuating the bowl so as to flush waste therefrom.

4. A vacuum toilet assembly according to claim 1 in which air entering the bowl via the multiple air-inlet openings is subjected to an air-knife effect when the bowl is evacuated.

5. A vacuum toilet assembly according to claim 4 further comprising a shroud and in which the lid creates an air-impervious seal against the shroud when the lid is closed.

6. A vacuum toilet assembly according to claim 5 further comprising a shroud and in which the lid comprises means for creating an air-impervious seal against the shroud when the lid is closed.

7. A vacuum toilet assembly according to claim 5 in which the multiple air-inlet openings are below the shroud.

8. A method of removing waste from a toilet bowl comprising:

(a) providing a toilet assembly comprising:

i) a bowl comprising a wall defining a rim, a bottom section below the rim, and a waste-receiving opening;

ii) a moveable lid adapted, when closed, to cover the bowl;

iii) a system for introducing water into the bowl at or adjacent the rim; and iv) multiple air-inlet openings distributed around the rim and through the wall of the bowl at approximately the same level as the system for introducing water; and v) an evacuation system;

(b) closing the lid;

(c) evacuating the bowl; and (d) immediately mixing air and water upon entry into the bowl at a point well above the bottom section of the bowl.

9. The vacuum toilet assembly of claim 1, wherein about two and a half to about three ounces of water are used for flushing.

* * * * *